US005473313A

United States Patent [19]

Graebe, Jr.

[11] Patent Number: 5,473,313

[45] Date of Patent: Dec. 5, 1995

[54] WHEELCHAIR SEAT CUSHION

[76] Inventor: William F. Graebe, Jr., 208 Yorktown Dr., Collinsville, Ill. 62234

[21] Appl. No.: 153,350

[22] Filed: Nov. 17, 1993

[51] Int. Cl.[6] ..... G08B 21/00

[52] U.S. Cl. ..... 340/626; 340/667; 5/453; 297/452.41

[58] Field of Search ..... 340/626, 667, 340/573; 5/453, 454, 455; 297/452.41; 200/85 A

[56] References Cited

U.S. PATENT DOCUMENTS

| | | | |
|---|---|---|---|
| Re. 28,754 | 3/1976 | Cook | 340/573 X |
| 3,463,547 | 8/1969 | Brennan et al. | 297/459 |
| 3,503,649 | 3/1970 | Johnson | 297/459 |
| 3,533,095 | 10/1970 | Collins | 340/573 |
| 3,631,438 | 12/1971 | Lewin | 340/573 |
| 3,860,773 | 1/1975 | Fontaine | 200/85 A |
| 4,020,482 | 4/1977 | Feldl | 340/573 |
| 4,068,334 | 1/1978 | Randall | 5/365 |
| 4,086,458 | 4/1978 | Dickey | 200/85 R |
| 4,172,216 | 10/1979 | O'Shea | 200/85 R |
| 4,629,253 | 12/1986 | Williams | 297/452.41 |
| 4,638,307 | 1/1987 | Swartout | 340/666 |
| 4,726,624 | 2/1988 | Jay | 297/459 |
| 4,753,480 | 6/1988 | Morrell | 297/452 |
| 4,819,286 | 4/1989 | Beauchamp | 5/431 |
| 4,833,457 | 5/1989 | Graebe | 340/626 |
| 4,953,913 | 9/1990 | Graebe | 297/439 |

OTHER PUBLICATIONS

Seat Rite™ Model 18M Operating Instructions, no date.

*Primary Examiner*—Jeffery A. Hofsass
*Attorney, Agent, or Firm*—Heller & Kepler

[57] ABSTRACT

A wheelchair seating system preferably for use with an inflatable cushion device such as that incorporated herein by reference includes a base suitable for containing the components necessary to provide for either manual or automatic inflation and deflation of the lower cushion incorporated in the seating system and the upper cushion upon which a user sits.

20 Claims, 7 Drawing Sheets

WHEELCHAIR SEAT CUSHION

BACKGROUND OF THE INVENTION

The present invention relates in general to a wheelchair seat cushion, and pertains more particularly, to an inflatable wheelchair seat cushioning device in which all components necessary for inflation are contained within the device.

The sling style seats of conventional folding wheelchairs are known to cause decubitus ulcers to the wheelchair users. Sitting in a sling seat for extended periods of time increases seating pressures and associated forces upon the hips and thighs which effect the alignment of the pelvis and spine. Further, conventional sling seats restrict the movement of the user.

Alternative seating devices currently available do not adequately overcome these problems.

Inflatable cushions currently available have the inherent problems from air leaks, inaccurate adjustment, improper positioning, deterioration of the cushion, as well as over or under inflation. Changes in the inflation of these cushions occur due to leakage of the cushion or in the system, and with changes in temperature or altitude. These problems often result in the formation of sores and ulcers due to pressure points, especially in users with impaired sensation.

Further, prior cushions have been difficult to adjust, thereby decreasing the users mobility or necessitating assistance. The need for external pumps for inflation and the associated tubing further complicates installment and use, and interferes with folding the wheelchair for travel or storage.

SUMMARY OF THE INVENTION

An object of the present invention is to provide a firm but cushioned seat which provides stability and support.

It is a further object of the present invention to provide a flat seat support to the conventional sling seat of foldable wheelchairs.

A further object of the present invention to provide a cushioned seat support which is self-contained so as to be easily installed and removed, yet easily accessible to the user, without assistance, to allow continual adjustment of the cushion to insure proper adjustment at all times.

Still a further object of the present invention is to provide a seat support in which the cushion can be easily changed, and which is used to support and inflate an additional cushion such as that described in U.S. Pat. No. 4,833,457. The present invention preferably provides an inflatable support for the invention described in that issued patent and is not intended primarily for supporting someone sitting in a wheel chair. However, it will become apparent to one skilled in the art that with a change in the sensor arrangement of the present invention that the cushion could be used for support.

It is another object of the present invention to provide an alarm system which signals the user if the cushion becomes over or under inflated, or if the user is improperly positioned on the cushion.

Still another object of the present invention is to provide an inflated seat cushion which can be releasably attached to a wheelchair without the use of a sling seat.

To accomplish the foregoing and other objects of the invention there is provided a self-contained wheelchair support cushioning device which includes a support base contoured to sit securely in the sling seat of a conventional foldable wheelchair. The contoured shape of the base provides for internal storage of the device components. The support base has a flat lid which provides a firm platform for an air cushion to rest upon.

In a preferred embodiment, the device includes an alarm system which alerts the user as to over or under inflation of the cushion as well as improper positioning of the user on the cushion.

These and other objects of the invention will be better understood and appreciated from the following detailed description of preferred embodiments thereof, selected for purposes of illustration and shown in the accompanying drawings.

DETAILED DESCRIPTION

Figure 1:
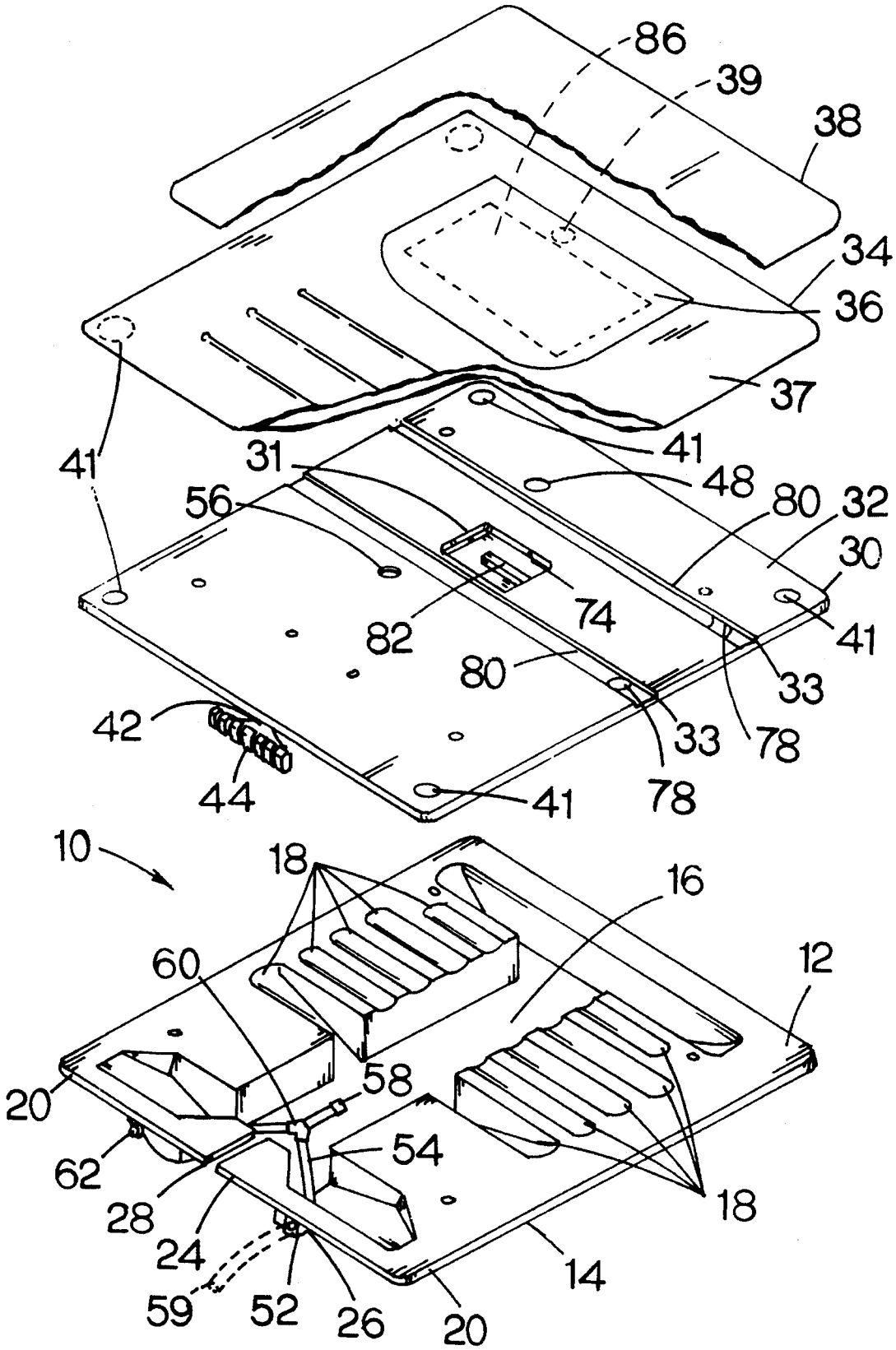
FIG. 1 is an exploded view of the seat cushion support device of the present invention.
Figure 2:
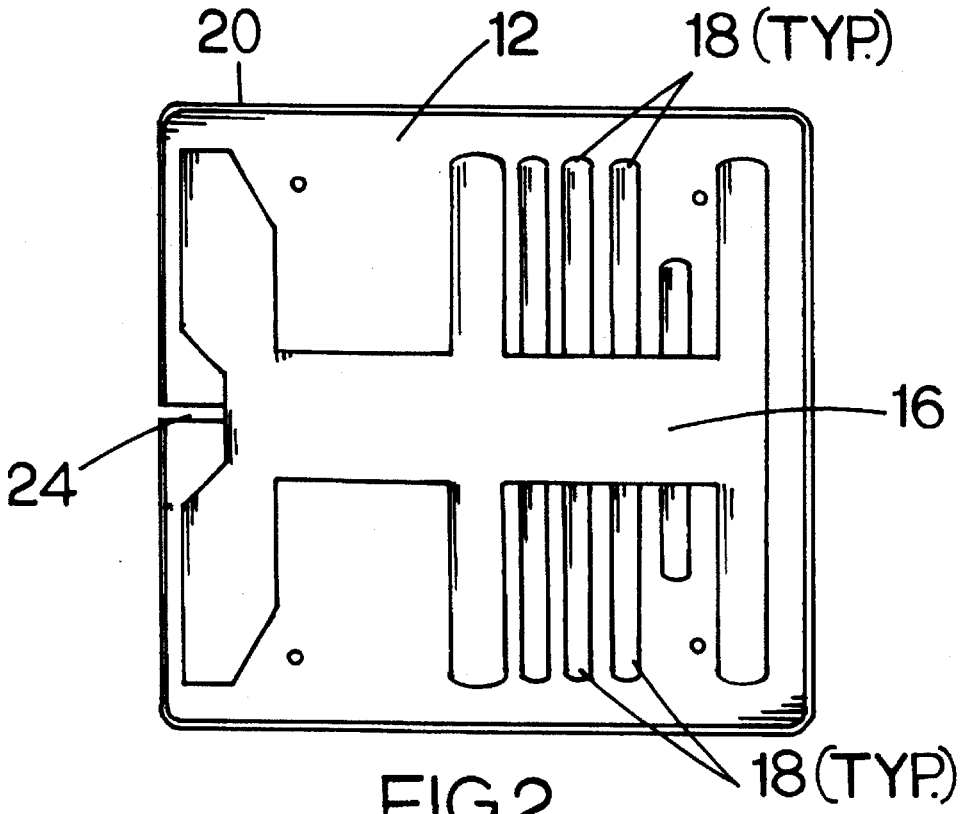
FIG. 2 is a top view of the invention illustrated in FIG. 1.
Figure 3:
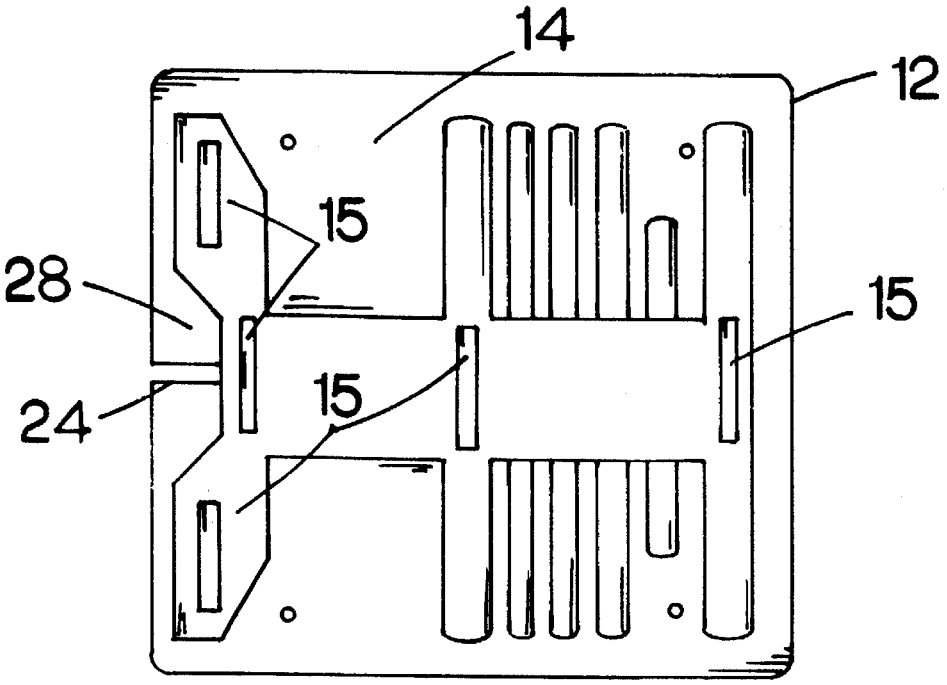
FIG. 3 is a bottom view of the invention illustrated in FIG. 1.
Figure 5:
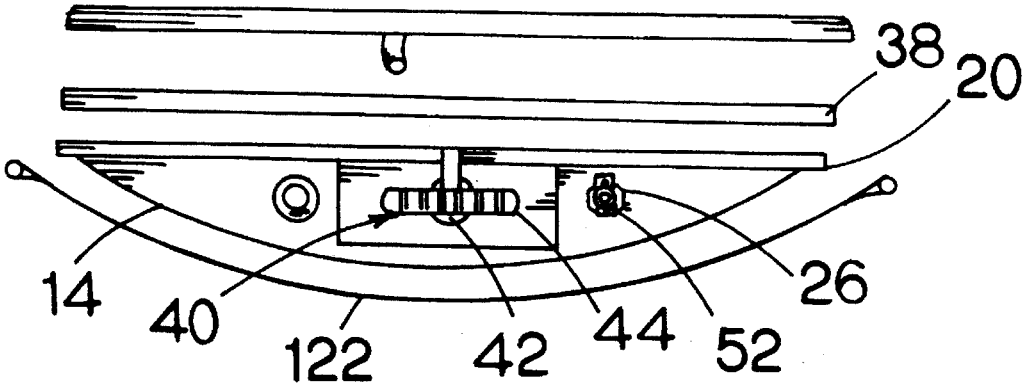
FIG. 5 is a front view of the invention illustrated in FIG. 1.
Figure 4:
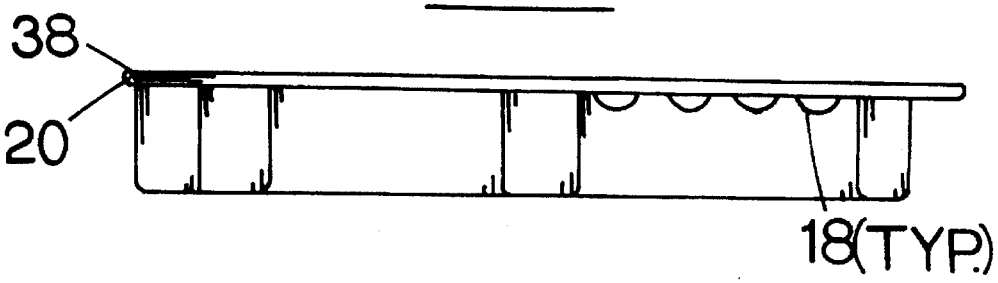
FIG. 4 is a side view of the invention illustrated in FIG. 1.

Referring now to the drawings there is shown a preferred embodiment for the cushioned seat support of the present invention. The seat of the present invention is particularly adapted for use with a conventional sling seat foldable wheelchair. The seat of the present invention is characterized by a contoured base which is shaped to sit securely within the wheelchair sling seat, and which provides component storage space resulting in a self contained unit.

The drawings show the seat, generally designated 10, including a contoured base 12, a base lid 30, and an air cushion 34 that rests upon the base lid 30 and is attached to an air inflation means as described below.

Figure 9:
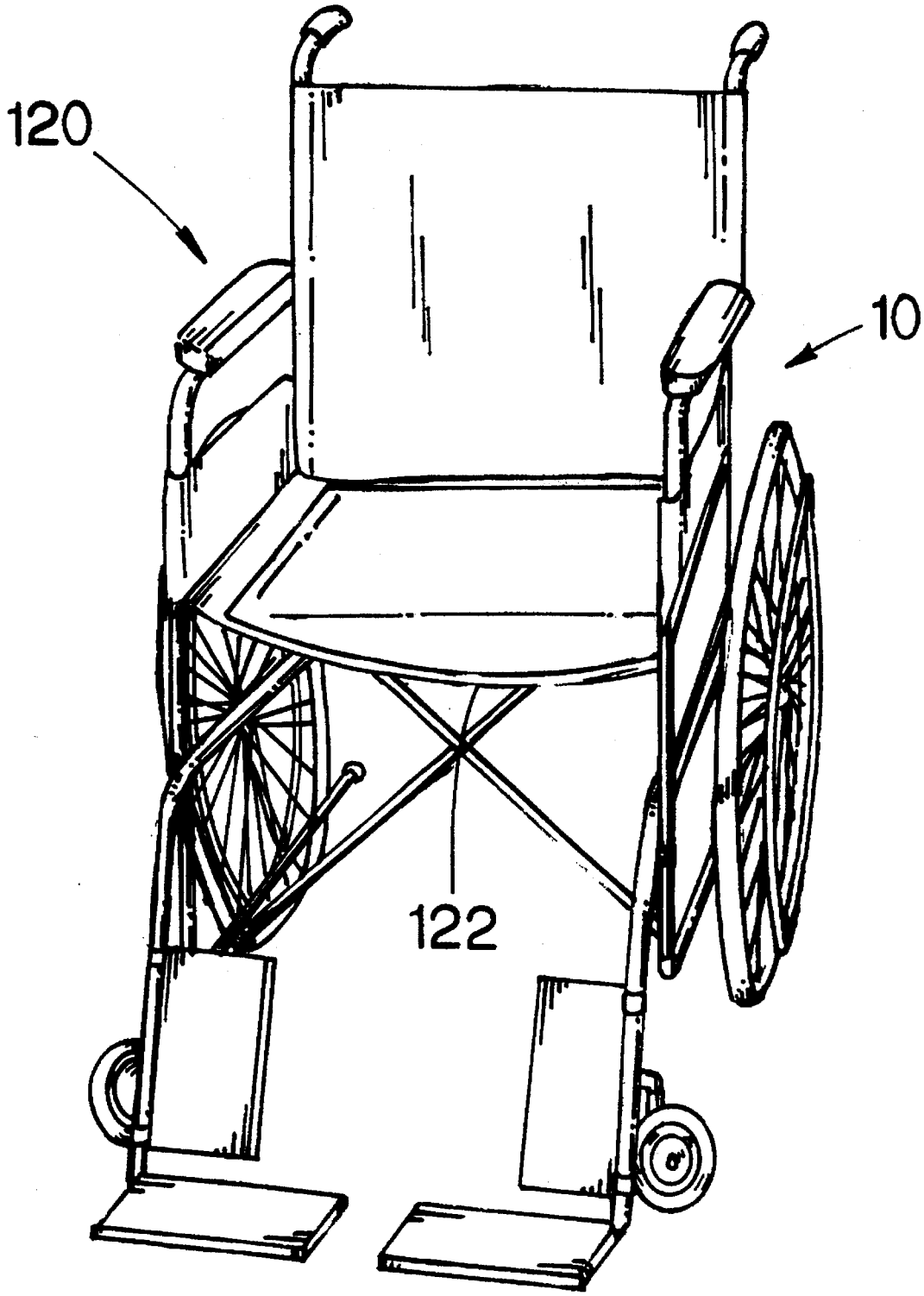
FIG. 9 is a perspective view of the invention illustrated in FIG. 1, the device being shown in combination with a conventional sling seat foldable wheelchair.

The contoured base 12 illustrated in FIGS. 2–5 has a contoured lower surface 14 which is shaped to sit securely in a sling seat 122 of a wheelchair 120 as shown in FIG. 9, and may include in one preferred embodiment one or more non-skid strips 15. Base 12 as presently preferred includes a main channel 16 and secondary channels 18 for storage of the device components described fully below. A lip or shoulder 20 is provided around the circumference of one preferred embodiment of the base 12 to accept and support base lid 30.

The base lid 30, when seated and fastened upon base 12, rovides a strong, generally flat surface 32. Surface 32 includes recessed portions 33.

The air cushion 34 rests upon the base lid 30. The cushion 34 includes a pocket 36 on a surface 37 opposite the lid 30, and the cushion 34 is preferably held in place by hook and loop material 41 at the four corners. A cover 38 encloses the device 10. The cover is further illustrated in FIG. 9.

A manual air pump 40 is secured to lid 30 and located within main channel 16 of base 12. A pump plunger 42 extends through an aperture or slot 24, the pump handle 44 being attached to the portion of the plunger 42 extending beyond and through aperture 24 of base 12. A recess 28 is formed into base 12 to accept and store the pump handle 44 when not in use.

The pump 40 is connected to the air cushion 34 by tubing 46, which extends through aperture 48 of lid 30, and connector 50.

An interconnect valve 52 is secured through base 12 aperture 26. Valve 52 is connected to the cushion 34 by tubing 54, which extends through aperture 56, and connector 58, and allows the cushion 34 to communicate with another cushion resting upon the cushion 34 such as the immersion control device and associated alarm system disclosed in U.S. Pat. No. 4,833,457, which is incorporated herein by reference. Communication can be accomplished by an intermediate length of tubing 59 connecting valve 52 and the fluid line connection 32 depicted in the identified U.S. Letters Patent. Thus, pump 40 inflates and release valve 62 deflates both cushion 34 and any associated cushion.

A t-joint 60 in tubing 54 connects the cushion 34 to an air release valve 62. Air release valve 62 is positioned to be easily accessible to the user.

Figure 7:
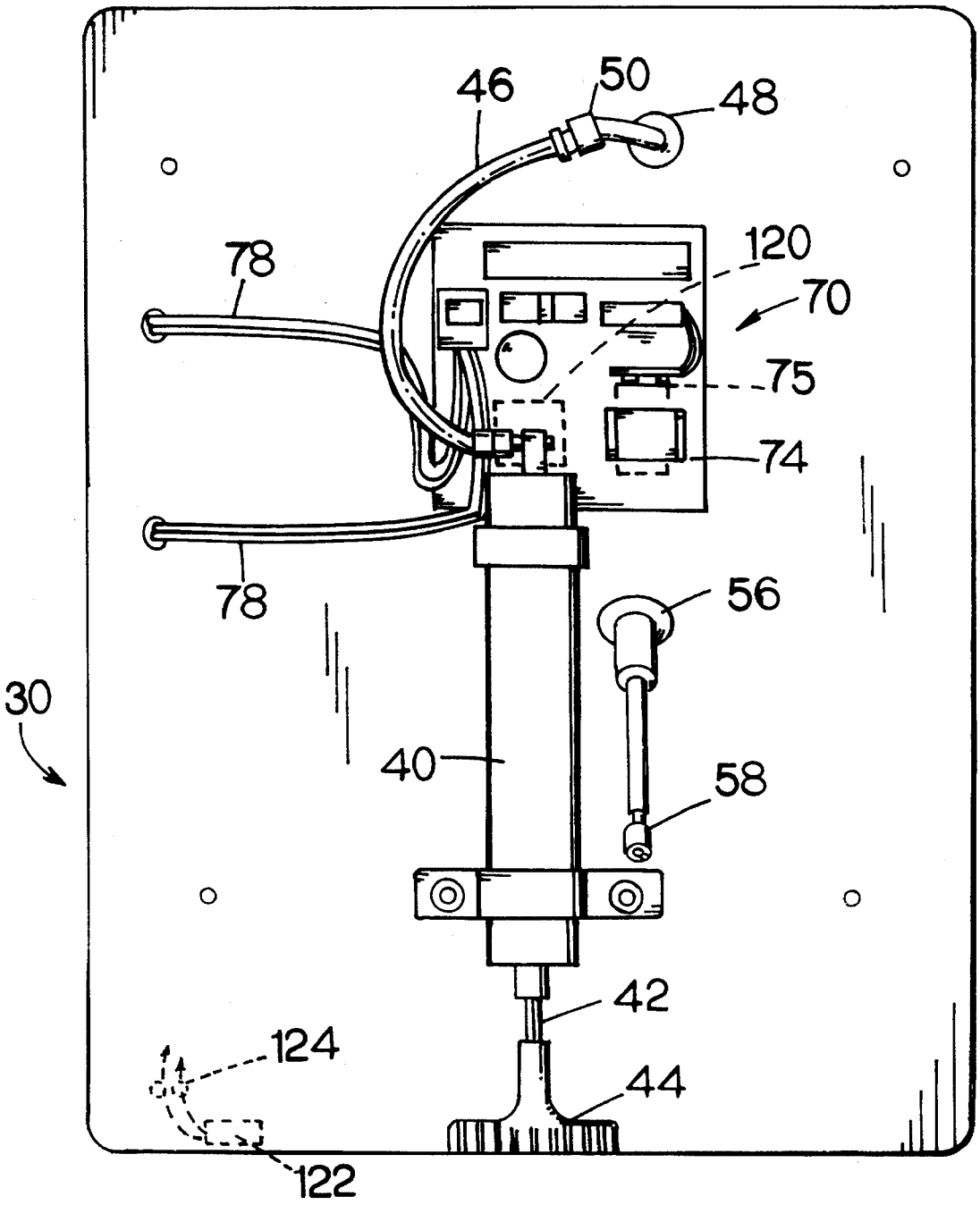
FIG. 7 is a view of the pump and alarm components of the device of the present invention.

An alarm system 70, shown in FIG. 7 utilizes a combination of copper switches such as conventional tape switches 80 which are pressure activated and a magnetic reed switch 82 to signal over or under inflation, as well as incorrect positioning. A circuit board 74 is secured to lid 30. The electronics of circuit board 74 or its equivalent is well known to those skilled in the art and is therefore not described in detail. The alarm system 70 is preferably powered by a battery 75, shown in dashed lines.

The corresponding pressure or tape switch wiring 78, as shown in FIG. 7 runs along lid 30 and extends into channels 18 of base 12 when device 10 is assembled. Several channels 18 are provided to allow the circuit board 74 position to be adjusted so that circuit board 74 is directly under the user, regardless of the user's size or preferred sitting position.

Two tape switches 80 are located within the recesses 33 of lid 30. Another sensor 82, a magnetic activated switch, is located on the circuit board 74 or other suitable mounting location so as to be directly under an aperture 31 in lid 30.

Figure 10:
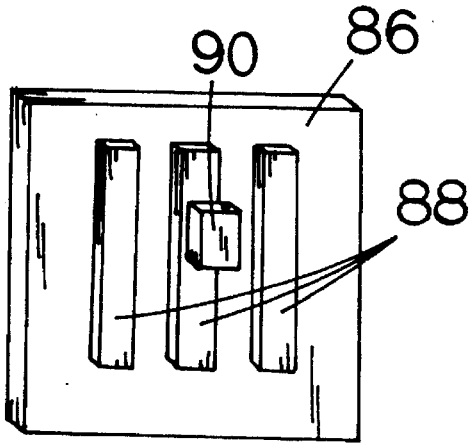
FIG. 10 is a plan view of the magnetic panel component of the present invention.

A generally rigid panel 86, shown in FIG. 10 is located within the pocket 36 of cushion 34. Panel 86 includes generally thin strips or shims of a rubber or equivalent material 88 and a thicker magnetic member 90. The panel 86 is oriented in pocket 36 so that the shims 88 are oriented generally perpendicular to the tape switches 80. Magnet 90 is positioned above the magnetic switch 82 so that the magnet 90 can pass through the aperture 31 and into operative proximity or operative contact with the switch 82.

In the event that the cushion becomes under inflated, the shims activate the tape switch by the weight of the person seated on the seating system and activates the alarm. In a preferred embodiment approximately 12 ounces is sufficient to close the copper switches in the tape switch. This is a typical operational characteristic for a twelve inch (12") long strip of tape switch.

In the event the cushion becomes over inflated, the distance between the magnet 90 and the reed switch 82 is sufficient to allow the reed switch to change from its normal position and thereby activate the alarm. The aperture allows clearance for the magnet portion 90 of the board 86.

The components of the circuit board 74 are selected so as to continuously monitor the circuits, and respond to either pressure (tape switch) or distance (magnetic reed switch) and sound the alarm.

These tape switches 80 and shim member or members 88 function so as to alert the user to improper positioning of the user. If the user is not properly positioned, or begins to slide off the cushion 34, the panel 86 may be moved so as to close the copper switch in one or both of the tape switches.

In other embodiments the force necessary to activate the tape switches or their equivalents can be increased by widening the shims or strips, for example, a 3" wide shim which spreads out the force over a greater area correspondingly increases the amount of force required to activate any conventional tape switch. Theoretically, the width of the shims can be selected so as to require a much greater force, such as 3 pounds to activate the switch. Similarly, if the shim thickness is increased then the cushion 34 will bottom out leaving a ¾ inch clearance rather than a ½ inch clearance. It will be understood that the thickness of the shims also changes the amount of air required in the cushion 34 to prevent under inflation or a bottom out condition.

The number of tape switches can vary. There is no reason why 10 tape switches couldn't be used rather than the 2 tape switches described with one of the preferred embodiments of the invention. The slots 18 are then further useful to provide for the wiring for additional tape switches. This allows a seating system to be designed with greater coverage of the tape switches and, therefore, to vary the amount of area covered by the tape switches. The area that is covered should always include at least the deepest part of the body, that is where the skeleton structure causes the greatest sensitivity to an improperly inflated cushion.

It will now be understood that if the user of the present invention crosses his or her leg or leans to one side, then the loading characteristics of the upper cushion change and greater inflation may be needed to keep the user from bottoming out. Thus, alarm provides a signal that tells the user that he or she is sitting in the wrong position or the addition of more air (greater inflation) is required to return the user to the desired position.

In use, the seat cushion device 10 is placed upon the wheelchair so that the rounded base surface 14 sits securely in the sling seat, as shown in FIG. 9. The cushion 34 is then inflated by pumping the manual pump 40 until the cushion is properly inflated. Proper inflation will be signalled by the absence of an alarm. The handle 44 is then pushed into the recess 28 of base 12 for storage.

Upon the sounding of an alarm, the user is alerted to check position and correct any inflation problems. If the cushion 34 is under inflated, the user simply pulls out the pump handle 44 and refills the cushion by pumping until the alarm ceases. If the cushion 34 is over inflated, the user presses the release valve 62 until the alarm stops.

Figure 6:
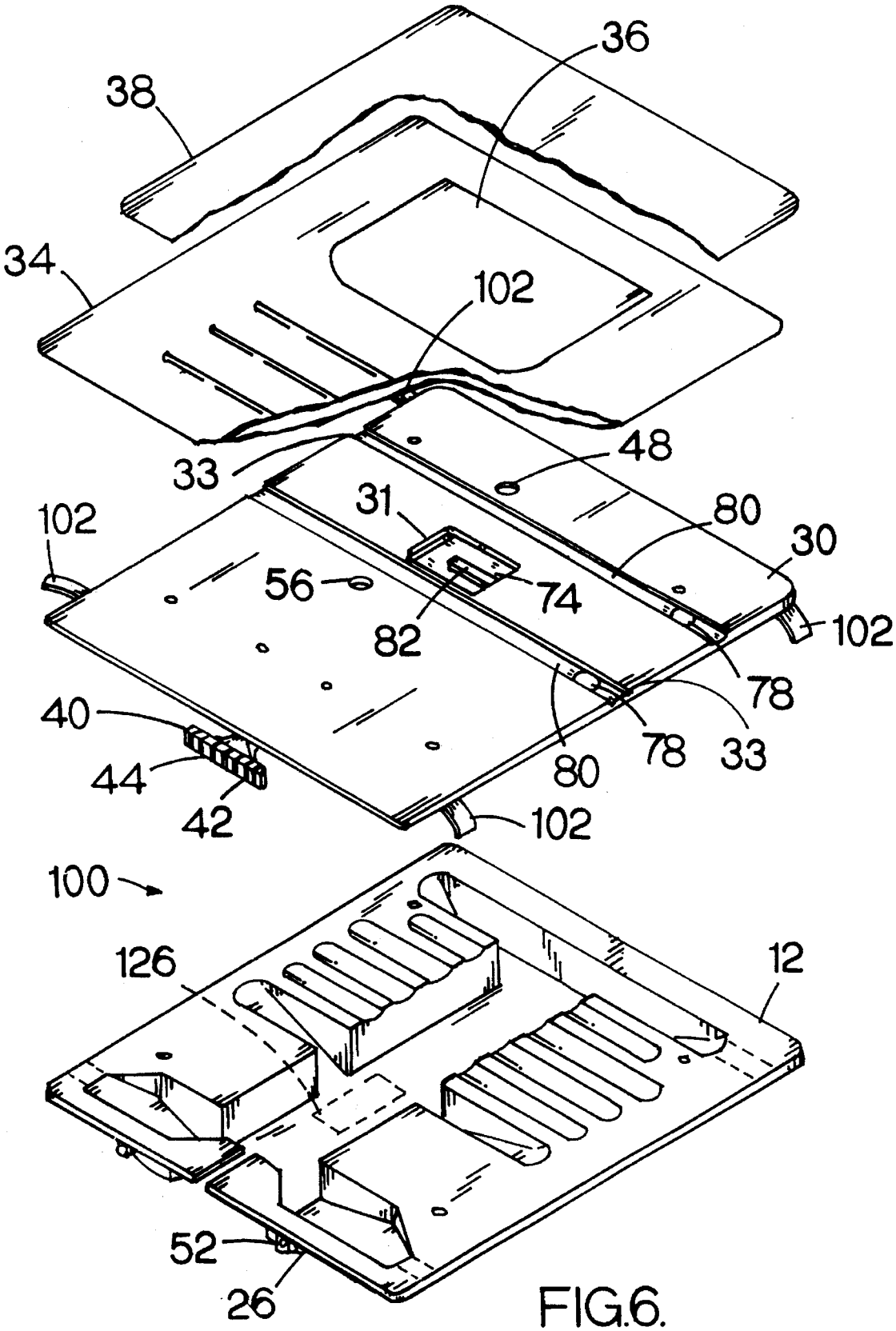
FIG. 6 is an exploded view of an alternative embodiment of the seat cushion support device of the present invention.

An alternative embodiment of the device of the present invention is shown in FIG. 6. In this embodiment the seat support 100 includes hooks 102 along the sides of the seat 100 which run parallel to the wheelchair rails. Hooks 102 can support the seat without the use of a sling seat on the wheelchair. The hooked attachment allows the seat 100 to be easily removed, allowing the wheelchair to be folded.

Figure 8:
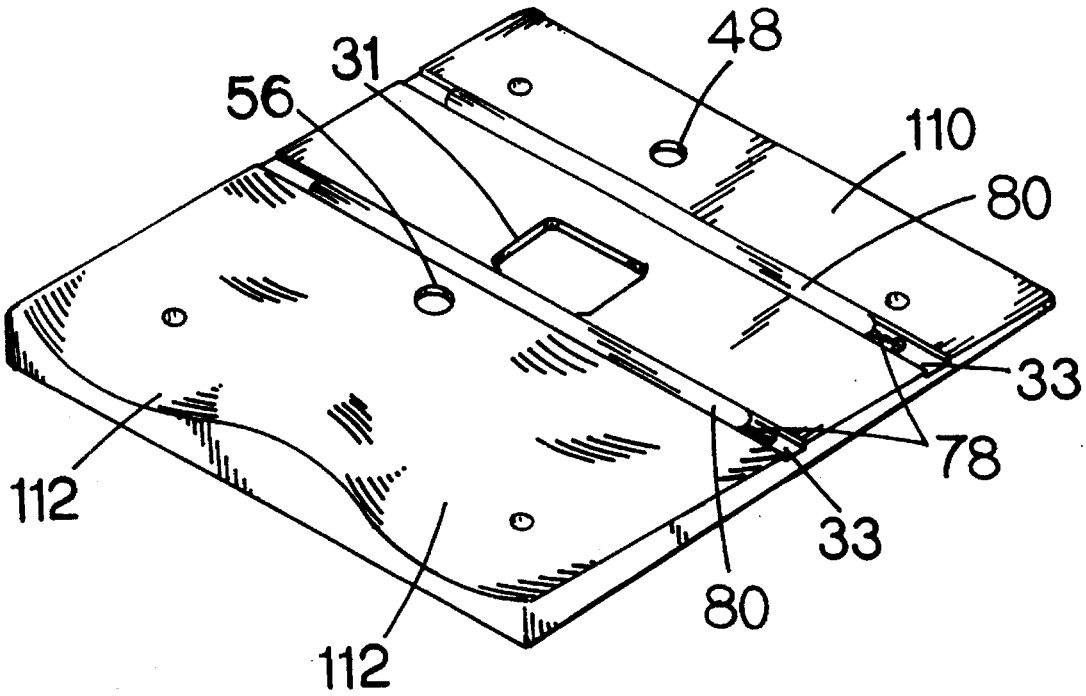
FIG. 8 is a perspective view of another alternative embodiment of the seat cushion support device of the present invention.

Another alternative embodiment of the device of the present invention is shown in FIG. 8. In this embodiment a lid 110 includes contoured seating portions 112. The seating portions 112 provide for better support and positioning of the user. Further, the seating portions 112 may be customized for the individual user.

In another embodiment an air pump or air compressor 120 takes the place of the pump 40. The air pump or compressor can be mounted on the circuit board 70 or within the compartment 16 of the base 12. In the event of over inflation, the reed switch 82 activates a solenoid operated relief valve 122. Wiring 124 connects the solenoid with the appropriate point of connection in the circuit on circuit board 70. In fact, the circuit board 70 of present embodiment of the present invention includes the connections for a solenoid. In the event of under inflation the tape switch or switches 80 activate the compressor or pump 120.

The use of an automatic system such as this requires additional voltage. The compartment 16 is can hold a battery holder 126 (shown schematically) for the additional batteries required for this embodiment. For example, it is believed that four D cell batteries would be preferred for operating this embodiment of the present invention. It will be understood by one skilled in the art that other battery options, such as a sealed lead acid battery, can be used.

From the foregoing description those skilled in the art will appreciate that all of the objects of the present invention are realized.

A seat is provided which provides a flat cushioned seat to a sling seat wheelchair to enhance support and stability. The seat provided is self-contained for ease in installation and removal, and provides easy access to the user for continual adjustment. The seat provided can be also be used in combination with an additional cushion.

Finally, the seat support provided an alarm system to alert the user of changes in the cushion, including over and under inflation, as well as alerting the user of improper positioning.

In an alternative embodiment, a seat is provided which can be attached to a wheelchair without use of a sling seat.

While a specific embodiment has been shown and described, many variations are possible. The presently preferred base is made of vacuum molded plastic. However, the base may be formed from any suitable material or method which produces a base with sufficient strength to support the user.

The base as disclosed includes channels to store the pumping and alarm components within the base, but any configuration, including a completely hollow base, which provides adequate space for the components may be used.

Although the base lid as presently preferred is a separate piece which sits on a shoulder in the base, any construction which provides a flat and sturdy support surface may be used.

While an alarm system utilizing proximity switches is advantageously used in this disclosure, any system capable of alerting the user to changes in inflation and position would be suitable. Further, the shapes, dimensions, and layout of the magnets and sensors disclosed may be altered without departing from the invention.

The alternative embodiment shown in FIG. 6 utilizes hooks to provide secure attachment with ease of removal. The hooks may be replaced with any releasably securing means, or the seat may be permanently attached if desired.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A self-contained cushioned seat support comprising:

a contoured base, the contoured base having a hollowed-out portion for receiving inflation means., an outwardly rounded lower surface, and upwardly extending vertical side wall portions, the wall portions including a shoulder along their uppermost edges;

a generally rigid base lid portion, the lid portion being supported by the shoulder of the contoured base in a horizontal position;

an inflatable air cushion, the cushion being supported by the base lid;

the inflation means to inflate the air cushion; and deflation means to deflate the air cushion.

2. The seat support of claim 1 wherein the contoured base is made of vacuum molded plastic.

3. The seat support of claim 1 wherein the inflation means is a manual pump.

4. The seat support of claim 1 further including an alarm means to alert a user of changes in the inflation of the inflatable cushion.

5. The seat support of claim 4 wherein the alarm means utilizes pressure activated switches and magnetic sensors to monitor changes in the inflation of the inflatable cushion.

6. A method for using the self contained cushioned seat support of claim 4 in combination with a conventional foldable wheelchair having a sling seat, the method comprising the steps of:

placing a self contained cushioned seat support upon a sling seat of a wheelchair;

positioning the self contained cushioned seat support with respect to the sling seat such that an outwardly rounded lower surface of the self contained cushioned seat support sits securely in the sling seat of the wheelchair;

seating a user upon the seat support, at which time an alarm will sound signaling under inflation of the cushion;

pumping a manual pump to inflate the inflatable cushion until proper inflation is attained, as is signalled by the ceasing of the under inflation alarm;

releasing air from the inflated cushion if the over inflation alarm sounds; and repeating the pumping and releasing steps as necessary to maintain proper inflation of the cushion in response to changes in the inflation of the cushion.

7. The seat support of claim 1 wherein the generally rigid base lid portion is contoured to provide better support and positioning of a user.

8. The seat support of claim 1 wherein the deflation means comprises a pressure relief valve.

9. The seat support of claim 1 further comprising one or more hooks for removably attaching the seat support to a conventional foldable wheelchair.

10. The method defined in claim 6 further including the optional steps of:

removing the sling seat from the conventional foldable wheelchair;

removably attaching the self contained cushioned seat support to the conventional foldable wheelchair and;

removing the self contained cushioned seat support from the conventional foldable wheelchair thereby allowing the wheelchair to be folded.

11. The method defined in claim 10 further including the step of:

adjusting an alarm means by varying at least one of the following, the width of at least one shim member, the thickness of at least one shim member, or the thickness of at least one magnet.

12. The method defined in claim 10 further including the step of:

adjusting an alarm means by varying at least one of the following, the width of at least one shim member, the thickness of at least one shim member, or the thickness of at least one magnet.

13. A self-contained cushioned seat support comprising:

a contoured base, the contoured base having a hollowed-out portion for receiving inflation means, an outwardly rounded lower surface, and upwardly extending vertical side wall portions, the wall portions including a shoulder along their uppermost edges;

a generally rigid base lid portion, the lid portion being supported by the shoulder of the contoured base in a horizontal position;

an inflatable air cushion including a pocket on its upper surface, the cushion being supported from underneath by the base lid;

inflation means to inflate the air cushion;

deflation means to deflate the air cushion; and alarm means to alert the user to changes in inflation of the inflatable cushion and changes in user position.

14. The seat support of claim 13 wherein the inflation means is a manual pump.

15. The seat support of claim 13 wherein the alarm means includes at least one pressure sensitive switch and the inflatable cushion pocket houses at least one shim member suitable for activating the pressure sensitive switch.

16. The seat support of claim 13 wherein the generally rigid base lid portion is contoured to provide better support and positioning of a user.

17. The seat support of claim 13 wherein the outwardly rounded lower surface of the contoured base has one or more non-skid strips.

18. The seat support of claims 13 wherein the alarm means includes at least one magnetic switch and the inflatable cushion pocket houses at least one magnet suitable for activating the magnetic switch.

19. The seat support of claim 13 wherein the alarm means includes at least one pressure sensitive switch and at least one magnetic switch, and the inflatable cushion pocket houses at least one shim member suitable for activating the pressure sensitive switch and at least one magnet suitable for activating the magnetic switch.

20. The seat support of claim 13 further comprising one or more hooks for removably attaching the seat support to a conventional foldable wheelchair.

* * * * *